US009649860B2

(12) United States Patent
Holtman et al.

(10) Patent No.: US 9,649,860 B2
(45) Date of Patent: May 16, 2017

(54) PRINTER FOR FORMING A PHASE CHANGE INKJET IMAGE

(71) Applicant: Océ-Technologies B.V., Venlo (NL)

(72) Inventors: Lodewijk T. Holtman, Venlo (NL); Henricus A. M. Janssen, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/947,749

(22) Filed: Nov. 20, 2015

(65) Prior Publication Data

US 2016/0144637 A1 May 26, 2016

(30) Foreign Application Priority Data

Nov. 21, 2014 (EP) ..... 14194302

(51) Int. Cl.

| | |
|---|---|
| ***B41J 29/38*** | (2006.01) |
| ***B41J 11/00*** | (2006.01) |
| ***B41J 2/175*** | (2006.01) |
| ***B41J 11/06*** | (2006.01) |
| ***B41J 13/00*** | (2006.01) |

(52) U.S. Cl.

CPC ..... *B41J 11/0085* (2013.01); *B41J 2/17593* (2013.01); *B41J 11/06* (2013.01); *B41J 13/0009* (2013.01)

(58) Field of Classification Search

CPC ..... B41J 11/0085

See application file for complete search history.

(56) References Cited

U.S. PATENT DOCUMENTS

2004/0114009 A1* 6/2004 Pan ..... G03G 15/104 347/88
2006/0071997 A1* 4/2006 Kruijt ..... B41J 2/17593 347/104
2009/0141110 A1* 6/2009 Gervasi ..... B41J 11/002 347/100

FOREIGN PATENT DOCUMENTS

| | | |
|---|---|---|
| EP | 1097821 A2 | 5/2001 |
| EP | 1 642 730 A1 | 4/2006 |
| EP | 1 661 723 A2 | 5/2006 |

* cited by examiner

*Primary Examiner* — Juanita D Jackson

(74) *Attorney, Agent, or Firm* — Birch, Stewart, Kolasch & Birch, LLP

(57) ABSTRACT

A printer is provided for forming a phase change inkjet image on a print substrate. The printer includes a sheet transport unit for advancing the sheet along a print station. The sheet transport unit includes a sheet support platen, a sheet attraction mechanism and a feed mechanism. The sheet support platen includes a print surface for supporting a contact side of the print substrate. The sheet attraction mechanism is arranged for attracting the print substrate to the print surface. The feed mechanism is arranged for advancing the print substrate in a transport direction over the print surface, wherein the feed mechanism is arranged upstream of the print surface. The print station includes a print head assembly, the print head assembly being arranged for providing ink droplets for forming the phase change inkjet image on a process side of the print substrate, the print substrate being arranged on a print area of the print surface, the process side being opposite to the contact side. The print surface has an average surface roughness Ra being in the range of 1 micron to 4 micron.

12 Claims, 5 Drawing Sheets

PRINTER FOR FORMING A PHASE CHANGE INKJET IMAGE

CROSS-REFERENCE TO RELATED APPLICATIONS

This application claims priority under 35 U.S.C. §119(a) to Application No. 14194302.7, filed in Europe on Nov. 21, 2014, the entire contents of which is hereby incorporated by reference into the present application.

BACKGROUND OF THE PRESENT INVENTION

1. Field of the Invention

The present invention relates to a printer for forming a phase change inkjet image on a print substrate. The present invention further relates to a method for forming a phase change inkjet image on a print substrate.

2. Description of Background Art

A known inkjet printing apparatus for forming a phase change inkjet image on a print substrate comprises a print station and a sheet transport unit for advancing the sheet along said print station. The print station comprises a print head assembly for forming the phase change inkjet image. Said sheet transport unit comprises a sheet support platen and a feed mechanism for feeding the print substrate along the sheet support platen. The sheet support platen comprises a print surface for supporting a contact side of the print substrate. The print surface comprises a plurality of suction holes, which are arranged in fluid communication to a suction source for attracting the print substrate to the print surface.

The feed mechanism, such as a feed nip, is adapted for moving the print substrate in a transport direction over the print surface. The feed mechanism is arranged upstream of the print surface in the transport direction.

The print head assembly may be supported on a carriage, which is movably arranged for moving the print head assembly in a print swath over the print surface in a direction perpendicular to the transport direction. The feed mechanism may be controlled for intermittently advancing the print substrate over the print surface in between successive print swaths. The print substrate is attracted to the print surface by a suction pressure, which is continuously provided through the suction holes of the print surface.

The print head assembly is arranged for providing fluid ink droplets of an ink at a first temperature above room temperature for forming the phase change inkjet image in a print area on a process side of the print substrate, the process side being opposite to the contact side. The ink is solid or semi-solid at room temperature, such as a hotmelt ink, and the ink must be heated above its phase change temperature, such as its melting point, before droplets of liquid ink can be jetted onto the print substrate. The fluid ink droplets cool down upon application on the print substrate to a second temperature below the first temperature, thereby obtaining a phase change, such as a crystallization phase change transition. The rate of cooling down of the ink droplets on the print substrate may control the crystal sizes, which are attained during the crystallization phase change transition.

Some print substrates, such as films having a smooth surface, being advanced over the print surface have a problem of temporarily sticking to the print surface, thereby either slipping and/or bulging from the print surface. On the other hand, in case of lowering the suction pressure to reduce the sticking behavior on the print surface, the print substrate may be supported loose on the print surface. As a result, the temperature of the print substrate when supported on the print surface may not be accurately controlled and the crystallization of the ink on the print substrate may become disturbed leading to irregular crystals patterns, such as having both larger and smaller crystals, in the phase change inkjet image.

SUMMARY OF THE INVENTION

It is accordingly an object of the present invention to provide a printer for forming a phase change inkjet image on a print substrate, wherein the sticking of print substrates, such as films, on the print surface is at least diminished and the crystallization of the phase change ink on the print substrate is properly controlled.

The present invention provides a printer for forming a phase change inkjet image on a print substrate, the printer comprising: a sheet transport unit for advancing the sheet along a print station, said sheet transport unit comprising a sheet support platen, a sheet attraction mechanism and a feed mechanism, the sheet support platen comprising a print surface for supporting a contact side of the print substrate, the sheet attraction mechanism being arranged for attracting the print substrate to the print surface and the feed mechanism being arranged for advancing the print substrate in a transport direction over the print surface, said feed mechanism being arranged upstream of the print surface; and a print station comprising a print head assembly, the print head assembly being arranged for providing ink droplets for forming the phase change inkjet image on a process side of the print substrate when the pint substrate is arranged on a print area of the print surface, the process side of the print substrate being opposite to the contact side, wherein the print surface has an average surface roughness Ra being in the range of 1 micron to 4 micron.

The phase change ink may be a hot melt ink, may be a radiation curable phase change ink, or may be any other ink obtaining a phase change when cooling down from a first temperature above room temperature at which the ink is jetted.

The lower limit of the average surface roughness Ra of 1 micron is the value at which the sticking of the print substrates, such as films, is considerably reduced. Below the lower limit, the films experience sticking at regular suction pressures. The higher limit of the average surface roughness Ra of 4 micron is the value at which the crystallization of the phase change ink is well controlled and the crystals in the phase change inkjet image attain a substantially regular pattern. Above the higher limit, an irregular pattern of crystals may grow in the phase change inkjet image. This irregular pattern disturbs the visual quality of the phase change inkjet image, such as non-uniform gloss of the image. The upper limit of the surface roughness is determined by a desired heat exchange between the print substrate and the print surface. A very rough surface means lesser contact points between the print surface and the print substrate and a lower heat exchange. With higher values than 4 micron the texture of the print surface becomes visual in the phase change inkjet image. The average surface roughness Ra is measured according to ISO 4287-1997.

The surface roughness of the print surface may be substantially uniform, such as having a repeated pattern, or may be randomly distributed.

The sheet attraction mechanism may be a mechanism for providing a suction force to the sheet. The sheet attraction mechanism may provide an electrostatic force between the sheet and the print surface or may be arranged for attracting the print substrate to the print surface. The feed mechanism may be a feed nip or any other mechanism for advancing the print substrate in a transport direction over the print surface.

In an embodiment, the average surface roughness Ra is at most 2 micron. In this embodiment, the surface roughness of the print surface may be substantially uniform, such as having a repeated pattern, without visually disturbing the phase change inkjet image. The upper limit of 2 micron is the upper limit for a print surface having a substantially uniform surface roughness. Such a uniform surface roughness may be easily obtained within defined limits, for example by uniformly machining the surface of a metal plate using known machine settings.

In an embodiment, the print surface comprises a support area arranged upstream of the print area in the transport direction to guide the print substrate from the feed mechanism to the print area.

In an embodiment, said attraction mechanism comprises a plurality of suction holes disposed in the print surface, said plurality of suction holes being arranged in fluid communication with a suction pressure source for providing a suction pressure to said contact side of the print substrate.

The suction pressure is provided for attracting the print substrate to the print surface. Commonly known suction pressures for attracting and to flatten print substrates are in the range of 100-500 Pa.

In an embodiment, said support area comprises a recess shaped as a suction buffer chamber, wherein said recess is arranged in fluid communication with at least one of said plurality of suction holes.

In an embodiment, the printer comprises a temperature control system arranged for controlling the temperature of said print surface being at least 25 degrees Celsius. The temperature control system may be arranged for controlling the print substrate during and after printing the phase change inkjet image on the print surface.

In an embodiment, the print surface further comprises a conditioning area arranged downstream of the print area in the transport direction for controlling the temperature of the print substrate, wherein the temperature control system is further arranged for controlling the temperature of said conditioning area.

In an embodiment, the sheet transport unit comprises a star wheel facing the support area and being arranged in rolling contact with the process side of the print substrate upstream of the print head assembly in the transport direction. Said star wheel comprises an axis of rotation and a plurality of projections. Said star wheel may comprise a cylinder supporting said plurality of projections. Said plurality of projections may for example be teeth and/or tips. Each projection projects from said axis of rotation in a radial direction. During rotation of the star wheel, the projections may provide a rolling contact with the print substrate. Each projection comprises a contact surface at an outer edge of said projection in the radial direction. Said contact surface of each projection is in printing operation arranged in rolling contact with the process surface of the print substrate. Said contact surface may for example be an edge of a tooth or a tip of a (tapered) projection. Preferably, said contact surface is a curved surface having a mean diameter of at least 0.05 mm perpendicular to the radial direction. More preferably, the mean diameter may be at least 0.1 mm. In particular, the mean diameter may be about 0.2 mm.

In another aspect of the present invention, a method is provided for forming a phase change inkjet image on a print substrate, the method comprising the steps of: advancing the print substrate by way of a feed mechanism in a transport direction over a print surface, said feed mechanism being arranged upstream of the print surface in the transport direction; supporting a contact side of the print substrate on the print surface; and providing ink droplets forming a phase change inkjet image on a process side of the print substrate when the print substrate is arranged on a print area of the print surface, the process side of the print substrate being opposite to the contact side, wherein the print surface has an average surface roughness Ra being between 1 micron and 4 micron.

The advancing of the print substrate over the print surface may be in a continuous movement, for example advancing during the printing step, and/or may be in an intermittent movement, such as in between printing swaths of a carriage while providing ink droplets on the process side of the print substrate.

In an embodiment, the print surface comprises suction holes and the supporting step further comprises providing a suction pressure through said suction holes to said contact side of the print substrate for attracting the print substrate to the print surface.

In an embodiment, the supporting step further comprises the step of controlling a temperature of the print surface being at least 25 degrees Celsius for controlling the temperature of the print substrate during the printing step.

In an embodiment, the print surface further comprises a conditioning area arranged downstream of the print area in the transport direction and the method further comprises the step of controlling the temperature of the print substrate in contact with the conditioning area after the printing step.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4B illustrates a plan view of the embodiment shown in FIG. 4A; and

FIG. 4C shows a detail D of the star wheel shown in FIG. 4A.

DETAILED DESCRIPTION OF THE PREFERRED EMBODIMEMTS

Figure 1:
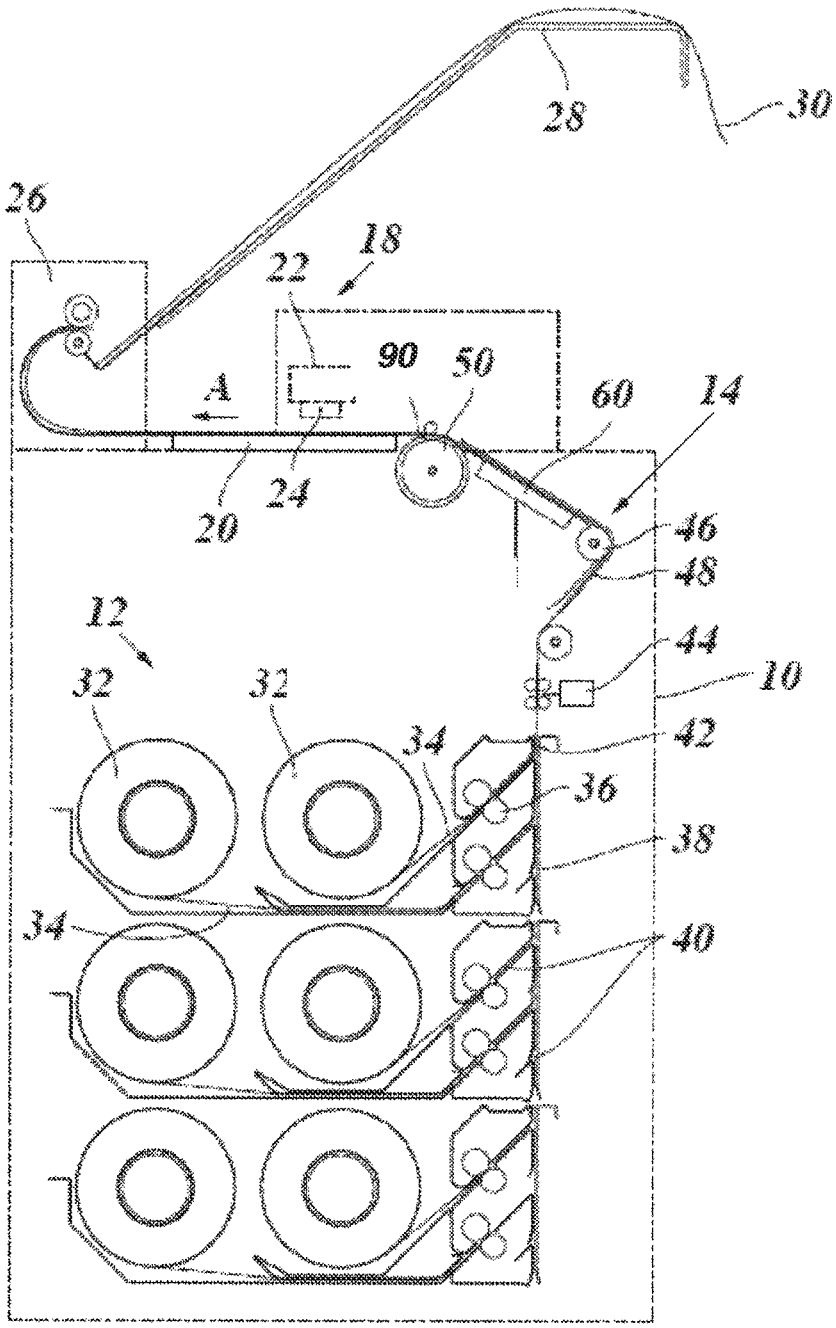
FIG. 1 is a schematic vertical cross-section of a paper transport system of a hot-melt ink jet printer according to the present invention.

The present invention will now be described with reference to the accompanying drawings, wherein the same reference numerals have been used to identify the same or similar elements throughout the several views.

As is shown in FIG. 1, a phase change ink jet printer comprises a frame 10 (which has only been shown in phantom lines), which accommodates a paper magazine 12 and a paper feed system 14 adapted to feed a print substrate 90 to a print station 18 on the top side of the frame 10. In the print station 18, the print substrate 90 is sucked against a flat print surface 21 of a perforated sheet support plate 20 by means of a vacuum system (not shown). A carriage 22 is arranged to travel back and forth across the print substrate 90 in the direction normal to the plane of the drawing in FIG. 1 and carries at its bottom side a number of phase change ink jet print heads 24 facing the print substrate 90. Thus, by energizing the print heads 24, a swath of an image is printed in each pass of the carriage 22. Then, the print substrate 90 is advanced by a feed nip 150 comprising a feed roller 50 by a step of appropriate length in a direction indicated by an arrow A in FIG. 1, so that the next swath can be printed. A discharge mechanism 26 discharges the sheet onto a tray 28 which, in the example shown, already accommodates a printed sheet 30. The sheet support plate 20 is temperature-controlled in order to control the cooling rate and the solidification of the phase change ink that has been deposited on the paper.

The paper magazine 12 comprises a set of six reels 32 each providing a supply of printing paper in the form of an endless web 34. The reels 32 are arranged in three levels, and the web 34 from each reel is drawn-off by means of a respectively associated pair of transport rollers 36. An arrangement of guide plates 38 defines a branched system of narrow feed paths 40, which merge into a common feed path 42 on the top side of the paper magazine 12. The pairs of transport rollers 36 are selectively driven to feed the web 34 from a selected one of the reels 32 to the common feed path 42. It will be understood that the reels 32 may contain paper of different qualities and possibly also non-paper recording media such as plastic films or the like. Further, the webs on the reels 32 may differ in width, so that printed sheets may be produced in different formats, ranging for example from A4 portrait to A0 landscape.

From the common feed path 42, the selected web is guided past a cutting mechanism 44 arranged for optionally cutting the web to a desired sheet length, such as in case of an error recovery operation. The cut print substrate 90 is guided over a system of deflection and tensioning rollers 46 and guide plates 48 to a feed roller 50 from which it is advanced along the sheet support plate 20. In case of feeding a film material as a print substrate 90, said film material may stick to said sheet support plate 20, for example due to electrostatic charges. Due to the sticking behavior, the print substrate may buckle upwards from the print surface 21, which may lead to touching the carriage 22 and or touching the print heads 24.

Figure 2A:
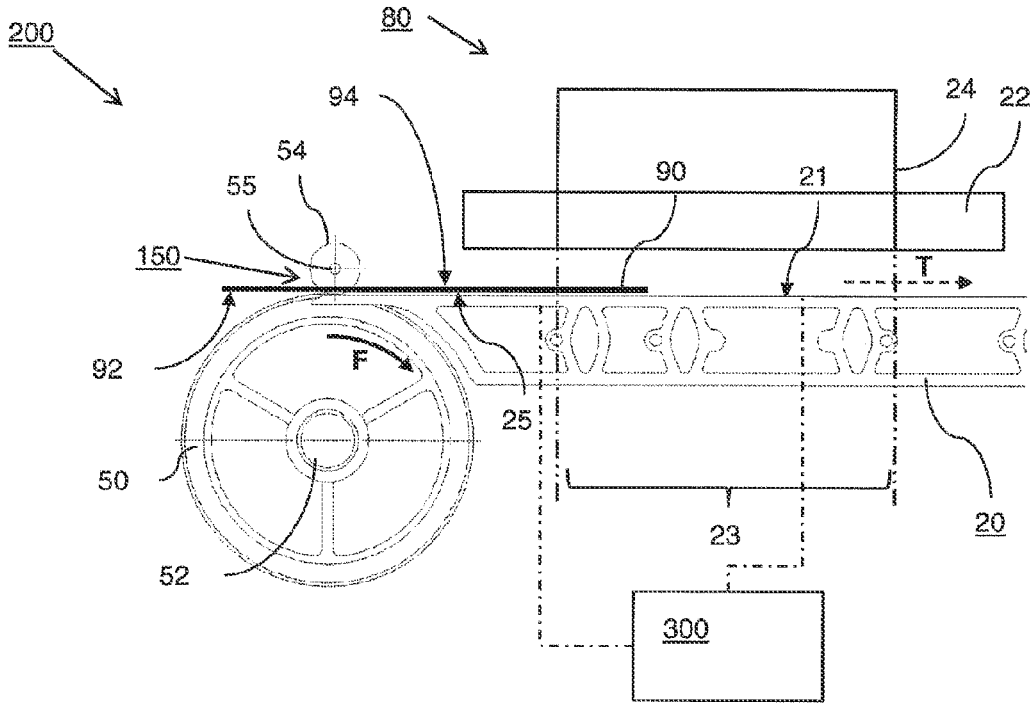
FIGS. 2A and FIG. 2B illustrate a sheet transport unit of a phase change inkjet printer according to an embodiment of the present invention.
Figure 2B:
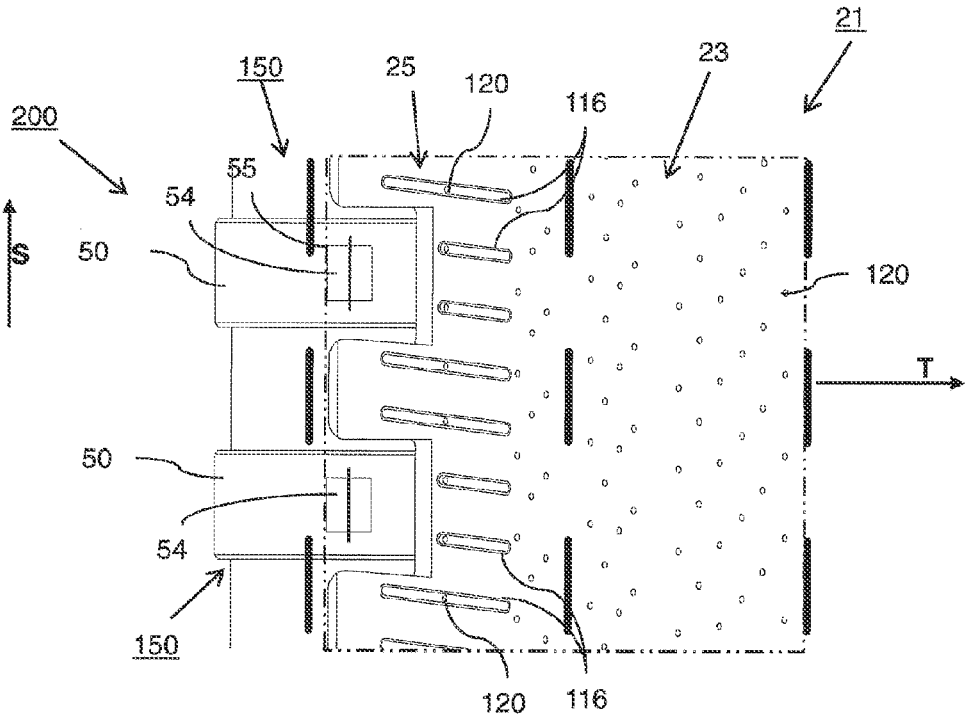

FIGS. 2A and 2B illustrate a sheet transport unit 200 of a phase change inkjet printer according to an embodiment of the present invention. The sheet transport unit 200 comprises a sheet support plate or platen 20. Said platen 20 comprises a print surface 21 comprising a print area 23 and a support area 25. The sheet transport unit 200 shown in FIG. 2A comprises a plurality of feed nips 150, each feed nip 150 being provided by a feed roller 50 and a pressure roller 54. The plurality of feed nips 150 is adapted for transporting a print substrate 90 in a transport direction T over a print surface 21. The plurality of feed nips 150 is arranged upstream of a print station 80 in the transport direction T. The print station 80 comprises a carriage 22 for supporting a number of inkjet print heads 24. The print heads 24 are arranged facing the print area 23. The support area 25 of the sheet support platen 20 is arranged upstream from the print area 23 in the transport direction T for guiding the print substrate 90 towards the print area 23.

Each of the feed rollers 50 is driven by a rotational feed axle 52 in a main rotational axis direction F in order to advance the print substrate 90 in the transport direction T. Each of the main rotational axis of the rotational axle 52 is aligned with respect to each other in a second direction S (as shown in FIG. 2B), which second direction is substantially perpendicular to the transport direction T (and is perpendicular to the plane of viewing of FIG. 2A).

The feed roller 50 engages the print substrate 90 on a contact surface 92 of the print substrate 90 for applying a driving force thereto. The pressure roller 54 is mounted on an axle 55, which pressure roller 54 is arranged opposite to the feed roller 50 facing a process surface 94 of the print substrate 90 and is urged towards the feed roller 50.

The print surface 21 has an average surface roughness Ra being in the range of 1 micron to 2 micron. The sheet support platen 20 is made of an alumina or other metal material, which can easily be shaped by machining. By carefully machining the print surface 21, said print surface 21 is made smooth and at the same time an average surface roughness Ra can be provided in the range between 1 micron and 2 micron.

The print surface 21 in the print area 23 and the support area 25 have substantially the same average surface roughness Ra. In an alternative embodiment, the print area 23 and the support area 25 may have a different average surface roughness Ra.

The print heads 24 are arranged facing the print area 23 for providing inkjet droplets of a phase change ink on the process surface 94 of the print substrate 90. The inkjet image formed attains the temperature of the print substrate 90. The phase change ink cools down and a crystallization phase change in the ink is obtained.

The effect of the average surface roughness Ra of the print surface 21 is that any print substrate, such as films, is advanced over the print surface 21 without sticking. At the same time, the effect of the average surface roughness Ra is that the temperature of the print substrate is controlled such that a uniform temperature is attained in the print substrate 90 and the crystals formed in the inkjet droplets on the process surface 94 of the print substrate 90 are substantially regular such that visual quality, such as gloss, of the inkjet image is uniform.

As can be seen in FIG. 2B, said support area 25 is arranged upstream of the print area 23 with respect to the sheet transport direction T and is partly extending between two adjacent feed nips 150. The print area 23 comprises suction holes 120 for holding the print substrate 90, wherein the ink jet print heads 24 are adapted to provide an inkjet image on the process surface 94 of the print substrate 90 in said print area 23. Said support area 25 comprises suction holes 120 and groove shaped recesses 116, wherein each recess 116 is arranged in fluid connection to a suction hole 120. The recesses 116 extend substantially in the transport direction T.

The printer further comprises a temperature control system 300 arranged for controlling the temperature of said print surface being at least 21 degrees Celsius. The temperature control system 300 may be arranged for controlling the print substrate 90 during and after printing the phase change inkjet image on the print surface 21.

Figure 3:
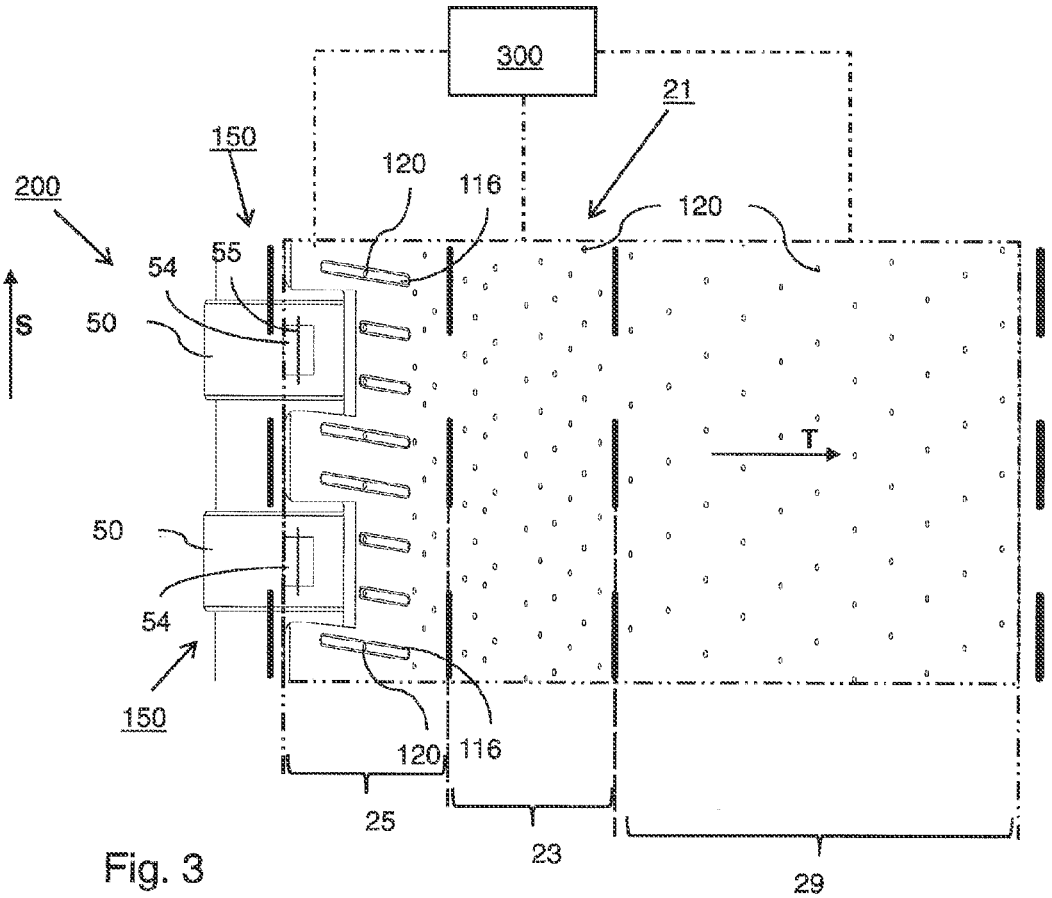
FIG. 3 illustrates a sheet transport unit of a phase change inkjet printer according to another embodiment of the present invention.

FIG. 3 illustrates a sheet transport unit 200 of a phase change inkjet printer according to another embodiment of the present invention. In FIG. 3 a plane view is shown of a sheet support plate or platen 20 comprising a print surface 21 and a feed nip 150 of the sheet transport unit 200.

The embodiment shown in FIG. 3 is a modified embodiment of the first embodiment shown in FIGS. 2A and 2B in that the print surface 21 comprises a print area 23, a support area 25, and additionally a conditioning area 29 arranged downstream of the print area 23 in the transport direction T.

The conditioning area 29 is arranged for controlling the temperature of the print substrate, wherein the temperature control system 300 is further arranged for controlling the temperature of said conditioning area 29.

The conditioning area 29 further supports a controlled crystallization of the phase change ink, especially when the crystallization process takes some time (for example in the range of 5-20 seconds). The print surface 21 in the print area 23, the support area 25, and the conditioning area 29 have substantially the same average surface roughness Ra in order to support the crystallization process of the phase change ink. In an alternative embodiment, the print area 23 and the conditioning area 29 may have a different average surface roughness Ra.

In another embodiment (not shown), a radiation curing unit is arranged facing the conditioning area 29 for radiation curing a radiation curable phase change ink, which is provided onto the process surface 94 of the print substrate 90 in the print area 23. The conditioning area 29 is arranged for controlling the temperature of the print substrate 90 during radiation curing of the radiation curable phase change ink on the process surface 94 of the print substrate 90 in the conditioning area 29. A person skilled in the art of radiation curing units and radiation curable phase change inks knows which temperatures are suitable to radiation cure the radiation curable phase change inks without disturbing the crystallization of the phase change ink. Furthermore a person skilled in the art of radiation curing units and radiation curable phase change inks knows which temperatures are suitable for curing the inkjet image constituted by the radiation curable phase change inks while controlling the phase change (such as crystallization) of the radiation curable phase change inks.

Figure 4A:
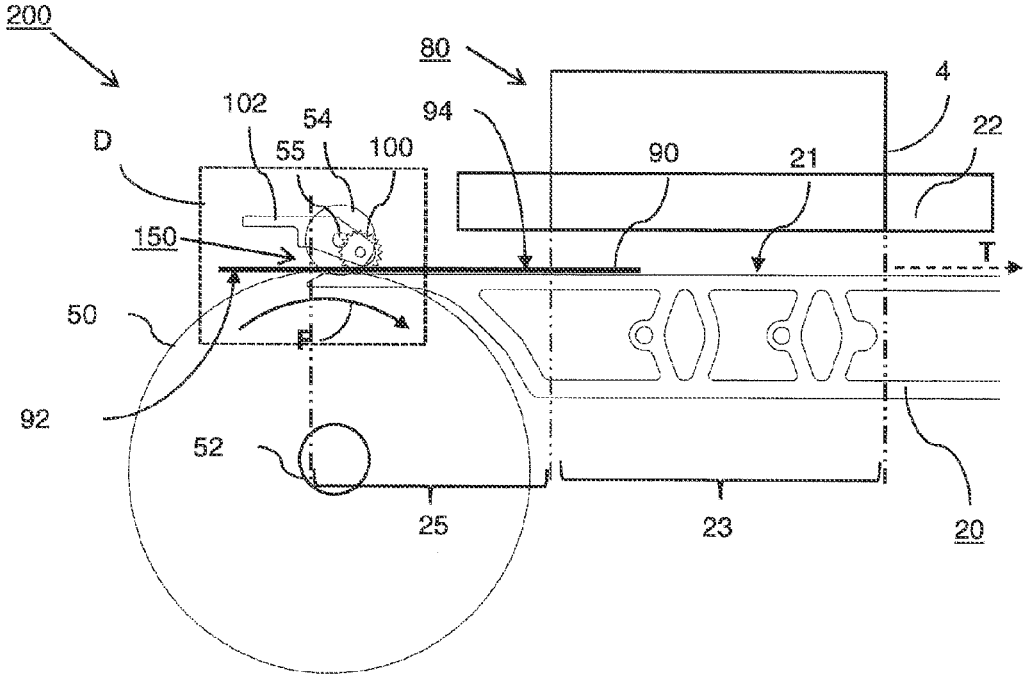
FIGS. 4A-4C illustrate a sheet transport unit of a phase change inkjet printer according to another embodiment of the present invention.
Figure 4B:
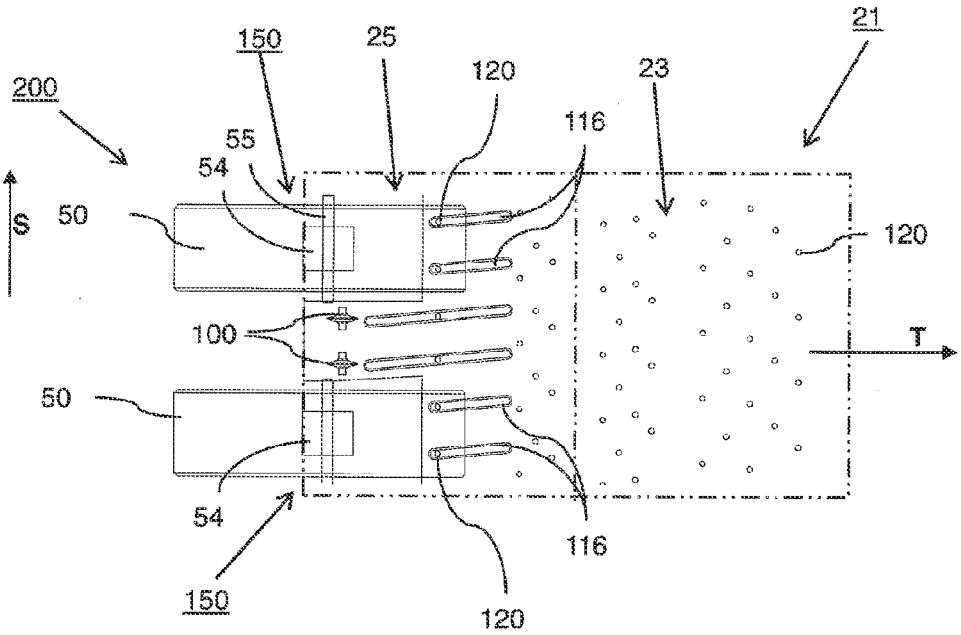

FIGS. 4A and 4B illustrate a sheet transport unit 200 of a phase change inkjet printer according to another embodiment of the present invention. The sheet transport unit 200 further comprises a star wheel 100, which is arranged facing the support area 25. During a printing operation, the star wheel 100 is arranged facing the process surface 94 of the print substrate 90.

Figure 4C:
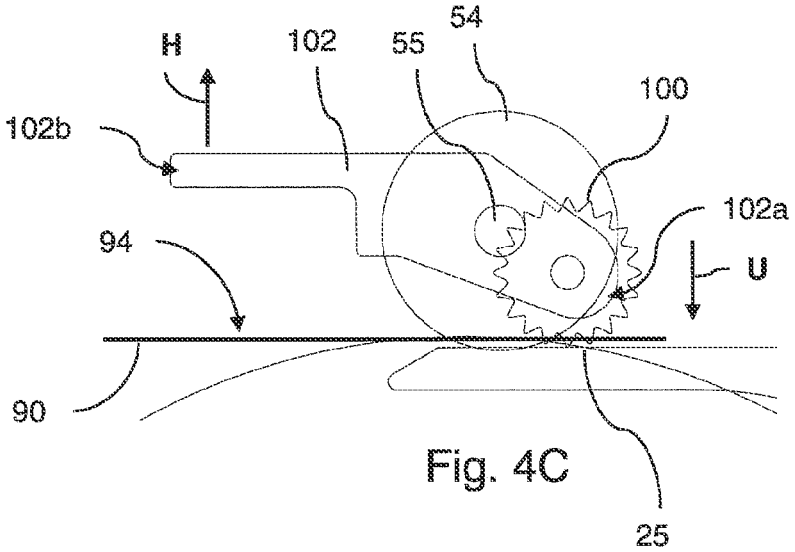

FIG. 4C shows a detail D of the star wheel shown in FIG. 4A. As shown in FIG. 4C, said star wheel 100 is mounted on a first end 102*a* of a supporting element 102. The supporting element 102 is rotatably mounted on the axle 55 of the pressure roller 54. The supporting element 102 is spring loaded at a second end 102*b*, opposite to the first end 102*a*, in a height direction indicated by arrow h in order to urge the star wheel 100 at the first end 102*a* towards the process surface 94 of the print substrate 90. The star wheel 100 is movable in the height direction h at the first end 102*a* of the supporting element 102, thereby providing flexibility for a thickness of the print substrate 90. For example, a preload of the star wheel 100 on the support area 25 is in the range 0-0.5 N. And a normal force urging towards the process surface 94 of the print substrate 90 is in the range 0.5-2.0 N when the star wheel is lifted 1 mm in the height direction h with respect to the support area 25. In case the normal force of the star wheel 100 is higher than 2.0 N, contact marks of the star wheel 100 on the process surface 94 of the print substrate 90 may become visible in inkjet images, which are provided by the print station 80 downstream of the star wheel 100 in the transport direction T.

The star wheel 100 comprises tips, which tips are arranged during operation of the star wheel 100 in rolling contact with the process surface 94 of the print substrate 90. The tips have a spherical shape having a mean diameter of about 0.2 mm. It is found that said tips do not disturb a crystallization pattern of a hot melt ink, which hot melt ink is a phase change ink forming a solid phase at room temperature, which hot melt ink is applied on the process surface 94 of the print substrate 90 in the print area 23 downstream of the star wheel 100 in the transport direction T.

The star wheel 100 is arranged in between two adjacent feed nips 150 in the second direction S as can be seen in FIG. 4B, thereby facing the support area 25. In the embodiment as illustrated in FIG. 4B, two star wheels 100 are arranged in between two adjacent feed nips 150 and are aligned with respect to each other in the second direction S. For simplicity, the supporting element 102 is not shown in FIG. 4B. The two star wheels 100 are arranged offset of the feed nips 150 in the transport direction T downstream of the feed nips 150, upstream of the print area 23 and upstream of the carriage 22 of the print station 80. Each of the star wheels 100 is arranged adjacent to an edge of said support area 25 in the second direction near one of the feed nips 150.

Said support area 25 is partly extending between two adjacent feed nips 150. The print area 23 comprises suction holes 120 for holding the print substrate 90, wherein the ink jet print heads 24 are adapted to provide an inkjet image on the process surface 94 of the print substrate 90 in said print area 23. Said support area 25 comprises suction holes 120 and groove shaped recesses 116, wherein each recess 116 is arranged in fluid connection to a suction hole 120. The recesses 116 extend substantially in the transport direction T. Each star wheel 100 is arranged near an end portion of a recess 116 in the transport direction T. A flattening of the print substrate 90 is enhanced by the combination of the star wheel 100 in rolling contact with the process surface of the print substrate 94 and a suction force provided by the suction hole 120 via the recess 116 on the contact surface 92 of the print substrate 92. In particular, the arrangement of the star wheel 100 near the end portion of the recess 116 enhances the flattening of the print substrate 90 on said recess 116 of said support area 25 upstream of the print area 23 in cooperation with the suction force provided by the recess 116.

The print surface 21 including the support area 25 has an average surface roughness Ra being between 1 micron and 2 micron. The effect of the surface roughness at the support area 25 is that the sticking of the print substrate 90 to the print surface 21 is reduced, thereby minimizing the tendency of the print substrate 90 to buckle from the print surface 21. As a result, a higher suction force may be applied to the contact surface 92 of the print substrate 90 for maintaining the print substrate 90 substantially flat.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A printer for forming a phase change inkjet image on a print substrate, the printer comprising:

a sheet transport unit configured to advance the print substrate along a print station, said sheet transport unit comprising a sheet support platen, a sheet attraction mechanism and a feed mechanism, the sheet support platen comprising a print surface for supporting a contact side of the print substrate, the sheet attraction mechanism being arranged for attracting the print substrate to the print surface and the feed mechanism being arranged for advancing the print substrate in a transport direction over the print surface, and said feed mechanism being arranged upstream of the print surface; and a print station comprising a print head assembly, the print head assembly being arranged for providing ink droplets for forming the phase change inkjet image on a process side of the print substrate when the print substrate is arranged on a print area of the print surface, the process side of the print substrate being opposite to the contact side, wherein the print surface has an average surface roughness Ra being in the range of 1 micron to 4 micron.

2. The printer according to claim 1, wherein the average surface roughness Ra is at most 2 micron.

3. The printer according to claim 1, wherein the print surface comprises a support area arranged upstream of the print area in the transport direction to guide the print substrate from the feed mechanism to the print area.

4. The printer according to claim 3, wherein said support area comprises a recess shaped as a suction buffer chamber, wherein said recess is arranged in fluid communication with at least one of said plurality of suction holes.

5. The printer according to claim 3, wherein the sheet transport unit comprises a star wheel facing the support area and being arranged in rolling contact with the process side of the print substrate upstream of the print head assembly in the transport direction.

6. The printer according to claim 1, wherein said sheet attraction mechanism comprises a plurality of suction holes disposed in the print surface, said plurality of suction holes being arranged in fluid communication with a suction pressure source, the suction pressure source being configured to provide a suction pressure to the contact side of the print substrate.

7. The printer according to claim 1, wherein the printer comprises a temperature control system arranged for controlling the temperature of the print surface being at least 25 degrees Celsius.

8. The printer according to claim 7, wherein the print surface further comprises a conditioning area arranged downstream of the print area in the transport direction for controlling the temperature of the print substrate, wherein the temperature control system is further arranged for controlling the temperature of said conditioning area.

9. A method for forming a phase change inkjet image on a print substrate, the method comprising the steps of:

advancing the print substrate by way of a feed mechanism in a transport direction over a print surface, said feed mechanism being arranged upstream of the print surface in the transport direction;

supporting a contact side of the print substrate on the print surface; and providing ink droplets forming a phase change inkjet image on a process side of the print substrate when the print substrate is arranged on a print area of the print surface, the process side of the print substrate being opposite to the contact side, wherein the print surface has an average surface roughness Ra being in the range of 1 micron to 4 micron.

10. The method according to claim 9, wherein the print surface comprises suction holes and wherein said step of supporting further comprises the step of providing a suction pressure through suction holes to said contact side of the print substrate for attracting the print substrate to the print surface.

11. The method according to claim 9, wherein said step of supporting further comprises the step of controlling a temperature of the print surface being at least 25 degrees Celsius for controlling the temperature of the print substrate during said step of providing ink droplets.

12. The method according to claim 11, wherein the print surface further comprises a conditioning area arranged downstream of the print area in the transport direction and wherein the method further comprises the step of controlling the temperature of the print substrate in contact with the conditioning area after said step of providing ink droplets.

* * * * *